US005133782A

United States Patent [19]

Wiand

[11] Patent Number: 5,133,782

[45] Date of Patent: Jul. 28, 1992

[54] MULTILAYER ABRADING TOOL HAVING AN IRREGULAR ABRADING SURFACE AND PROCESS

[76] Inventor: Ronald C. Wiand, 18500 Fairway Dr., Detroit, Mich. 48221

[21] Appl. No.: 471,095

[22] Filed: Jan. 26, 1990

Related U.S. Application Data

[63] Continuation of Ser. No. 326,152, Mar. 20, 1989, which is a continuation-in-part of Ser. No. 310,783, Feb. 14, 1989.

[51] Int. Cl.[5] ..... B24D 11/00

[52] U.S. Cl. ..... 51/295; 51/298; 51/309

[58] Field of Search ..... 51/295, 309, 298

[56] References Cited

U.S. PATENT DOCUMENTS

| | | | |
|---|---|---|---|
| Re. 21,165 | 7/1939 | VanDerPyl . | |
| Re. 26,879 | 5/1970 | Kelso . | |
| 1,848,182 | 3/1932 | Koebel . | |
| 1,939,991 | 12/1933 | Krusell . | |
| 2,201,196 | 5/1940 | Williamson . | |
| 2,367,406 | 1/1945 | Kott . | |
| 2,396,015 | 3/1946 | Liden et al. . | |
| 2,427,565 | 9/1947 | Liger . | |
| 2,705,194 | 3/1955 | St. Clair | 51/293 |
| 2,828,197 | 3/1958 | Blackmer, Jr. . | |
| 3,037,852 | 6/1962 | White . | |
| 3,088,251 | 5/1963 | Davis . | |
| 3,206,893 | 9/1965 | Rumbaugh . | |
| 3,247,301 | 4/1966 | Praeg et al. . | |
| 3,293,012 | 12/1966 | Smiley et al. | 51/293 |
| 3,615,309 | 10/1971 | Dawson | 51/309 |
| 3,751,283 | 8/1973 | Dawson | 117/22 |
| 3,850,590 | 11/1974 | Chalkey et al. . | |
| 3,860,400 | 1/1975 | Prowse et al. . | |
| 3,869,263 | 3/1975 | Greenspan | 51/209 |
| 3,894,673 | 7/1975 | Lowder et al. . | |
| 3,918,217 | 11/1975 | Oliver | 51/295 |
| 4,010,583 | 3/1977 | Highberg | 51/284 |
| 4,018,576 | 4/1977 | Lowder et al. . | |
| 4,047,902 | 9/1977 | Wiand | 51/295 |
| 4,063,909 | 12/1977 | Mitchell . | |
| 4,114,322 | 9/1978 | Greenspan | 51/206 |
| 4,142,872 | 3/1979 | Conradi . | |
| 4,163,647 | 8/1979 | Swiatek | 51/295 |
| 4,246,004 | 1/1981 | Busch et al. | 51/309 |
| 4,543,106 | 9/1985 | Parekh | 51/295 |
| 4,681,600 | 7/1987 | Rhoades et al. . | |
| 4,697,653 | 10/1987 | Peterson | 51/295 |
| 4,883,500 | 11/1989 | Deakins et al. | 51/309 |
| 4,916,869 | 4/1990 | Oliver | 51/293 |
| 4,931,069 | 6/1990 | Wiand | 51/309 |

*Primary Examiner*—William R. Dixon, Jr.
*Assistant Examiner*—Willie J. Thompson
*Attorney, Agent, or Firm*—Harness, Dickey & Pierce

[57] ABSTRACT

A multilayer abrading tool is produced by first providing a tool substrate with an irregular abrading surface. The irregular surface is covered with metal balls which are brazed thereto to form a structured surface. An abrasive grit coating is provided by mixing a temporary binder, an abrasive grit material and an infiltrant powder material. This coating is then applied to the structured surface. The tool is then heated to drive off the binder and to cause infiltration of the infiltrant in the abrasive grit to form a multilayer of diamond grit suspended in a braze matrix which is attached to the structured surface of the tool substrate.

3 Claims, 1 Drawing Sheet

MULTILAYER ABRADING TOOL HAVING AN IRREGULAR ABRADING SURFACE AND PROCESS

CROSS-REFERENCE TO RELATED APPLICATION

This application is a continuation of U.S. patent application Ser. No. 326,152, filed Mar. 20, 1989, which is a continuation-in-part of U.S. application Ser. No. 310,783, filed Feb. 14, 1989.

BACKGROUND

The present invention relates to diamond layered abrading tools. More particularly, the present invention relates to a multilayer diamond abrading tool produced without a mold.

In the past, it has been desirable to produce diamond abrading wheels and other abrading tools. Of these prior tools, the most common types include tools having a monolayer of grit and multilayer grit tools. The single layer grit structures include a metal substrate which has a single layer of diamond grit particles attached thereto to provide the abrading surfaces. While these tools provide advantages in cost of manufacture over other abrading tools, they may have a limited life for grinding of certain materials. This is a problem because through the course of grinding operations, the diamond grit particles eventually come loose reducing the efficiency of the abrading tool.

On the other hand, the multilayer tools include several thicknesses of dispersed diamond cutting grit, thus, providing continued layers of usable grinding surfaces beyond the initial surface layer of diamond grit. In the past, in order to provide such a multilayer diamond grit abrading tool configuration, it was required to provide a mold to produce the necessary shape when sintering a diamond grit matrix onto a core. This is most effectively accomplished by molding with heat and compression, such that an advantageous multilayer wheel or the like surface would be produced and attached to the substrate tool structure.

Because of the necessity of molds and tooling for these sintered multilayer abrasion tools, the capital expenditures for equipment and costs of production are high. Additionally, it has been inherent in the manufacturing process that there is much wasted material during final machining of these molded multilayer abrading wheels.

In the present invention there is provided a method for producing a multilayer diamond abrading structure on an abrading tool having an irregular abrading surface without the use of molding and/or pressure. This advantageously provides a less expensive and more efficient method of producing a multilayer abrading tool.

SUMMARY OF THE INVENTION

According to the present invention there is provided a process for forming a multilayer abrasive surface on an abrading tool as follows. First, a structured surface is provided on an abrading tool having an irregular surface thereof by brazing a plurality of metal balls to the irregular surface of the abrading tool. The structured surface preferably includes raised abrading protrusions, concavities or depressions thereon. Next, an abrasive grit coating is provided by mixing preselected quantities of a temporary binder, abrasive grit material and an infiltrant material. The abrasive grit coating is then applied to the structured surface and heated for a time and at a temperature which provides for driving off of the temporary binder and brazing the abrasive grit particles onto the structured surface of the tool. An additional layer of abrasive grit is provided by applying an additional layer of abrasive grit material to the layer of abrasive grit coating prior to the step of heating the assembly.

Additional benefits and advantages of the present invention will become apparent from the subsequent description of the preferred embodiments and the appended claims taken in conjunction with the accompanying drawings wherein like numbers differing by 100 refer to like elements.

DESCRIPTION OF THE PREFERRED EMBODIMENTS

Figure 1:
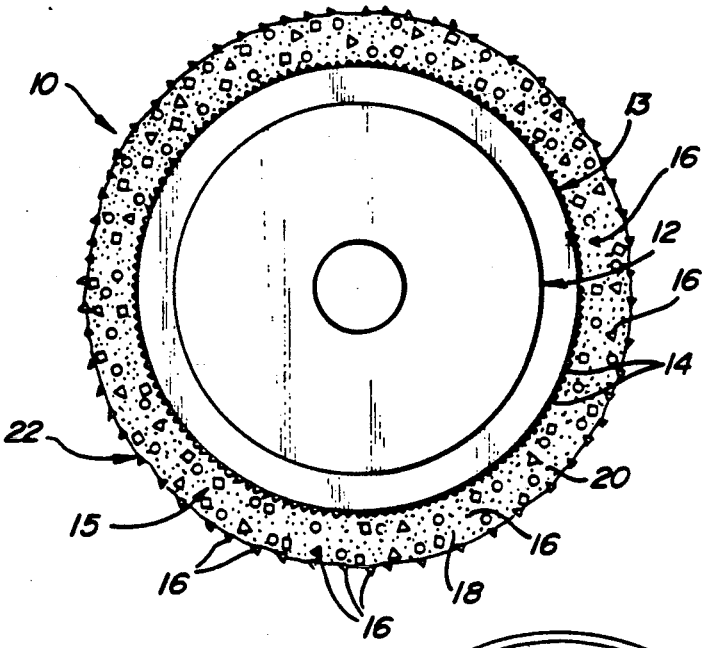
FIG. 1 is a cross-sectional view of an abrading tool prepared in accordance with the teachings of the present invention prior to the step of heating the tool.
Figure 2:
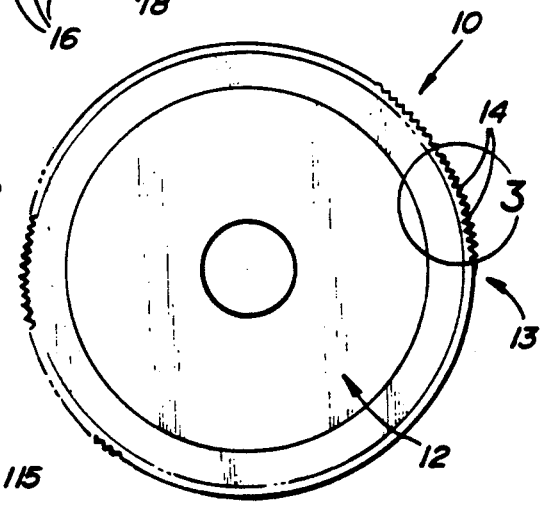
FIG. 2 is a cross-sectional view of the abrading tool of FIG. 1 after the heating step of the present invention.
Figure 4:
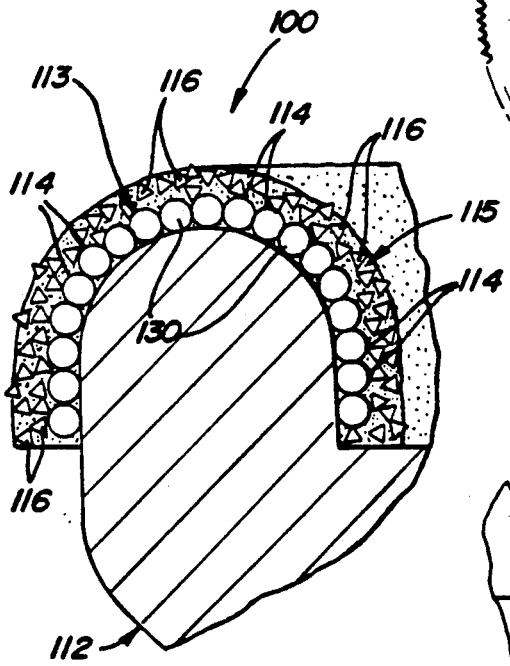
FIG. 4 is a detailed cross-sectional view of an alternate embodiment of a multilayer tool in the "green" state having a structured surface formed by brazing of metal balls onto the operative abrading surface of a toric curve generator wheel.
Figure 3:
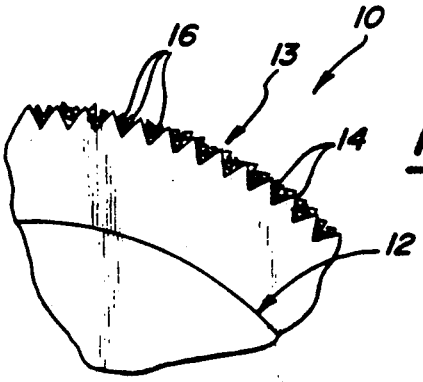
FIG. 3 is a detailed cross-sectional view of the completed multilayer tool construction as accomplished by the teachings of the present invention.

Referring now to the drawings, the layers utilized in the present invention are somewhat exaggerated in FIG. 1 for purposes of illustration. According to the present invention there is provided a process for forming a multilayer diamond abrading tool 10. The process of the present invention may be accomplished substantially without use of a mold as required in prior processes. As a first step of the process of the present invention, an abrading tool 12 is initially provided. Preferably, the abrading tool 12 includes a structured surface 13. The structured surface 13 includes abrading protrusions 14 which provide an advantageous form for a final grinding or abrading surface configuration and facilitates the production of an even multilayer abrasive grit surface on the structured surface.

An abrasive grit coating 15 is formulated by mixing preselected quantities of an abrasive grit, an infiltrant material and a temporary binder 20. This abrasive grit coating is then applied to the structured surface 13 and thereafter, the completed assembly is heated for a time and at a temperature which will drive off the temporary binder and allow the infiltrant to liquify and infiltrate the non-melting constituents and abrasive grit particles thereafter acting as a matrix to secure the abrasive grit and other non-melting constituents to the structured surface of the tool (for purposes herein the term "non-melting" refers to constituents which are non-melting with respect to the infiltrant used). Additionally, a further layer of abrasive grit is accomplished by applying an outer layer 22 of diamond grit particles 16 over the abrasive grit coating layer prior to curing of the temporary binder, i.e., while the binder is still wet or tacky.

In accordance with the teachings of the present invention, an abrading tool 10 is provided which includes a tool substrate 12, such as a core of a grinding wheel to which a multilayer abrasive grit surface is desirable to be attached. The substrate 12 includes a structured surface having a series of raised abrading protrusions 14 thereon which act as a surface for attachment of the abrasive grit particles. The structured surface may be of many suitable forms. As shown in the drawings, a knurled surface around the periphery of a grinding wheel type abrading tool is preferred. The surface may be formed by forming knurles, grooves, projections, recesses, concavities or depressions in the tool itself or by bonding a screen-like material or other perforated or textured metallic or high temperature resistant material onto the tool substrate 12. The tool substrate 12 may also include a smooth surface without deviating from the scope of the present invention. In an alternate embodiment of the present invention a structured surface may be advantageously provided on a concave, convex or other irregular surface of tool 112 by brazing a plurality of metal balls or spheres 130 to the concave or convex surface. This structure provides the advantages of a structured surface below but has the further advantage of being an advantageous method to form a structured surface on an irregular abrasion tool surface. The size of the balls used may be varied according to the final use of the abrading tools. A structured surface has been found to be advantageous in that during the heating step a structured surface results in a substantially even coating of the final multilayer coating as further set forth below.

The balls may be brazed prior to applying the abrasive grit coating. Alternatively, the step of brazing the metal balls may be accomplished by forming a paste of an infiltrant such as a braze with a temporary binder; applying this paste coating to the irregular surface and sprinkling or otherwise applying a tightly packed layer of balls to the tool surface while the coating is still tacky. Thereafter, the abrasive grit coating may be applied and the tool heated, which will form the multilayer matrix coating and braze the balls onto the tool by the same heating step.

The abrasive grit coating 15 is formulated by mixing suitable quantities of a temporary binder, abrasive grit such as a diamond grit material and a powdered infiltrant such as a braze composition in a suitable container.

The temporary binder 20 may be any of the type which will readily suspend these materials in a form which will coat and temporarily adhere to the structured surface of the substrate providing a generally even coating. It is preferable that the binder is relatively viscous such that the diamond particles and braze matrix components can be suspended in the binder and will provide a coating thickness which is greater than the diameter of the diamond particles used such that a multilayer of diamond grit is facilitated by the initial "green" coating. The binder must also be relatively inert in the sense that it will not adversely affect the components it is being mixed with and must also be suitable such that it can be driven off such as by volatilization from the remaining material prior to the liquification of the braze. It has been found that a suitable binder is a urethane material. Other suitable binders include acrylic resins, methylmethacrylate resins, lacquers, paints and the like. Other binders may be utilized to provide various characteristics in the final multilayer. For instance, water/flour or water/sawdust binders may be used to produce a more porous final multilayer matrix if desired. In some instances where the product is to be directly converted into the final tool, water alone could be used as a temporary binder to temporarily adhere the mixture to the tool substrate. A preferred urethane binder material includes a Wall Colmonoy "type S" viscous water soluble urethane cement.

While preferably, a binder is utilized in the present invention, the invention may be practiced substituting and taking advantage of gravity to temporarily adhere the abrasive grit infiltrant coating to the tool substrate. As an example, face grinding wheels may be advantageously produced in accordance with the teachings of the present invention by placing the face of the wheel in a horizontal plane and coating the face with the mixture of infiltrant powder and other matrix constituents if desired suspending the abrasive grit therein. Thereafter, a second layer of abrasive grit may be deposited over the first layer. These steps may be sequentially repeated until a desired predetermined thickness is reached. Then the wheel may be heated to allow the infiltrant to infiltrate the abrasive grit and other non-melting constituents to produce the final multilayer abrasive coating on the face grinding wheel.

Preferably, the abrasive grit material useful in the present invention will be one which may be suitably bound by the brazing materials carried in the "green" coating during the heating process. It is preferable that a diamond grit or diamond like hardness grit be used as the abrasive grit, however, other abrasive grits known to those skilled in the art, such as cubic boron nitrite, tungsten carbide, aluminum oxide, emery, silica carbide and others, would be equally suited for use in the present invention. Suitable sized grit or diamond particle material will be selected according to the final application of the abrading wheel and the substrate on which the multilayer is to be applied. It has been found that when used in accordance with the teachings of the present invention, a smaller diamond particle size will cut at about the same speed as the prior art tools utilizing larger size grit. For example, it has been found that an 80–100 grit tool prepared in accordance with the teachings of the present invention perform characteristically like a 60–80 grit prior art abrading tool. Thus, the cutting speed is increased while at the same time presenting a finished surface characteristic of a finer grit wheel.

Suitable infiltrant materials for use in the present invention include braze powders such as Wall Colmonoy L.M. brazes and the like as are known in the diamond abrasive brazing art. A Wall Colmonoy L.M. 10 NICROBRAZ® stainless brazing filler metal containing 7.0% chromium, 3.1% boron, 4.5% silicone, 3.0% iron and the balance nickel is suitable for use in the present invention. The coating mixture may also include fillers. Diamond setting materials and other matrix forming constituent materials (collectively shown as 24) are known in the art. A Wall Colmonoy no. 6 SPRAYWELL® hard surfacing powder is a preferable addition as a filler to provide suitable matrix for the diamond multilayer.

Other additions to the brazing mixture can be used without deviating from the scope of the present invention. For instance, it may be advantageous to use tungsten carbide additions to produce a better wearing diamond matrix. The amount of braze and/or matrix materials may be adjusted according to the desired properties and/or uses of the final grinding tool. For instance, larger quantities of braze used in the present invention, will produce a final matrix having physical properties similar to the braze material. Likewise, if lower quantities of braze are used with higher quantities of fillers, the final matrix will have physical properties more characteristic of the fillers used.

Generally, preferred diamond grit paste coatings include from about 5% to about 50% by volume binder; from about 1% to about 50% by weight diamond grit particles; from about 2% to about 100% by weight braze; from about 2% to about 94% by weight surfacing powder and from about 2% to about 94% by weight tungsten carbide. Typically, coatings of the present invention will include from about 20% to about 30% parts by volume binder; from about 1% to about 10% by weight diamond grit; from about 37% to about 50% by weight brazing composition; from about 40% to about 70% by weight surfacing powder; and from about 15% to about 18% by weight tungsten carbide. Preferably, mixtures useful in the present invention include about 40% by volume binder; about 1% by weight diamond grit particles; about 59% by weight braze; and 30% by weight surfacing powder and about 10% by weight tungsten carbide.

In the method of the present invention the abrasive grit coating 15 is applied over the structured surface 13 of the abrading tool in a relatively even and uniform layer over all the surfaces of the tool. Application may be done by any suitable means including brushing, spraying or dipping and the like. Thereafter, it is preferable that another layer 15 of abrasive grit material be added to the outer surfaces of the substrate structure. This may be done by rolling the wheel in abrasive grit particles 16 or by sprinkling the particles 16 onto the abrasive grit coating 15 mixture prior to curing of the binder. The abrasive grit particles used on the outer layer 18 are generally the same as those used in the coating. Additional layers may be added as desired by first allowing the binder to cure, and repeating the steps of coating with the abrasive grit coating and applying diamond particles. These steps may be repeated as desired to build up the coating to a predetermined thickness. Preferably, several layers are provided until the knurling is essentially filled in.

The completed tool with the abrasive grit coating and outer diamond sprinkled layer is thereafter either allowed to cure or directly placed in a suitable oven, such as a vacuum furnace, for heating of the entire structure in order to drive off the temporary binder and either simultaneously or consecutively to provide the heat to melt the brazing composition for infiltration and brazing the diamond matrix onto the tool surface. A temperature of from about 1700° to about 1950° F. is found to be suitable for this heating step. Preferably, the assembly is placed in a vacuum furnace and heated to a temperature of about 800° F. for driving off of the urethane binder and thereafter the temperature is raised to about 1890° F. for allowing the braze material to liquify and infiltrate the abrasive grit matrix and attach it to the tool substrate.

While not wishing to be bound by any particular theory of operation, it is believed that the use of a structured surface, such as a knurled surface is advantageous in that it retains and prevents the braze from flowing and infiltrating the matrix structure unevenly during the liquious state of the braze. The structured surface is also believed to facilitate multidirectional flow and uniform distribution and leveling of the abrasive matrix across and around the periphery of the wheel. This "evening" of the multilayer is believed to be the result of the large surface area provided by the knurling in combination with the radiant heating used. It is believed that this larger surface area heats faster and remains at a higher temperature during the heating process which draws the braze evenly onto the knurled surface, because of the natural tendency of molten braze to be drawn to the higher temperature surface.

The examples below are given as further illustrations of the present invention and are not to be construed to be limiting to the present invention.

EXAMPLE I

A structured tool substrate was prepared by providing a peripheral wheel 6 inches in diameter by 1 inch thick. The wheel was knurled around the outside diameter of the wheel core with a knurling tool that having 16 grooves per inch. The knurl forms a cross hatch pattern on the surface of the periphery of the steel core having grooves which are about 0.020 inches deep and 0.020 inches from peak. Thus, providing a series of projections about the periphery of the wheel. A coating mixture of urethane, diamond 100–120 grit, Wall Colmonoy L.M. braze and Wall Colmonoy hard surfacing powder no. 6 and tungsten carbide are mixed in the following proportions as shown in Table I below.

TABLE I

| Constituent | Amount |
|---|---|
| urethane* | 40% by volume |
| diamond 100/120 grit | 10 carats |
| Wall Colmonoy L.M. braze** | 50 grams |
| Wall Colmonoy hard surfacing powder no. 6*** | 100 grams |
| 200 mesh tungsten carbide | 20 grams |

*Wall Colmonoy type ±S' water soluble cement
**Wall Colmonoy L.M. 10 NICROBRAZ ®
***Wall Colmonoy no. 6 SPRAYWEL ®

The coating was mixed in a suitable container forming a paste like consistency material and applied with a brush evenly and uniformly into and over the knurled surface of the wheel approximately 1/16" thick. Immediately thereafter, 100/120 grit diamond was sprinkled over the coated surface. Thereafter, the wheel as prepared above was placed in a vacuum furnace held at a vacuum of $10^{-5}$ torr, first at a temperature of about 800° F. for 15 minutes and thereafter the temperature was raised to about 1890° F. for about 3.25 minutes. The resulting product was cooled and a multilayer diamond coating of substantially even thickness was found to be brazed onto the knurled surfaces of the wheel. The wheel was tested comparatively against a monolayer grinding wheel in grinding glass of optical lenses. The monolayer wheel was found to be unsuitable after grinding of 3 lenses while the grinding wheel of the present invention was found to be suitable for grinding of over 1000 lenses.

EXAMPLE II

A structured substrate is produced by providing a peripheral wheel 6 inches in diameter by 1 inch thick. An eight wire mesh is attached to the core by brazing it thereon. The paste mixture set forth in Table I is thereafter spread onto the wire mesh surface. Immediately thereafter, 80–100 grit diamond is sprinkled on the coated surface. The resulting product is then placed in a vacuum furnace first at a temperature of about 800° F. for 15 minutes and thereafter at about 1890° F. for 3.25 minutes. The grinding wheel is removed from the oven and allowed to cool. The diamond particles are found to be brazed onto the surface in a multilayer.

EXAMPLE III

The abrading surface substrate of a toric curve generator abrading wheel is sandblasted on the area to be coated with balls and diamond. A paste of Wall Colmonoy LM braze and polyvinyl alcohol gel was spread on the prepared surface. While the paste is tacky, steel shot balls of the size 0.015" are sprinkled onto the pasted surface to form a uniformly, closely packed layer of balls. After the drying of the paste, a mixture of 30 weight percent "LM" braze, 58 weight percent Colmonoy #6 powder and 12 weight percent 200 mesh Tungsten Carbide (WC) were mixed with 40 volume percent "S" cement manufactured by Wall Colmonoy. To 100 grams of this mixture was added, 2 grams of 40/50 grit diamond. The resultant slurry was spread onto the surface formed by the balls. While the surface is still wet, 40/50 grit diamonds were sprinkled onto the surface and allowed to become cemented into place as the slurry dries by evaporation or forced drying. Another layer of the "S" cement, diamond, "LM", #6 and WC slurry is coated over the first layer and another sprinkling of diamond on top of that slurry is added so that a matrix of diamond was developed.

The resultant tool was furnaced in a vacuum in gradual heating through 400° F. and 750°-1,000° F. until a temperature of 1900° F. is obtained. The tool was cooled in vacuum and removed.

An abrasive tool having a convex abrasive surface formed by the balls brazed onto the surface which have a diamond matrix attached to the balls forming the surface are formed.

While the above description constitutes the preferred embodiments of the present invention, it is to be appreciated that the invention is susceptible to modification, variation and change without departing from the proper scope and fair meaning of the accompanying claims.

What is claimed is:

1. An abrading tool having a multilayer abrasive grit matrix surface layer produced without a mold, said abrading tool comprising:

a rigid abrading tool substrate including an irregular surface, a structured abrading surface comprising a plurality of metal balls brazed to said irregular surface, a multilayer of abrasive particles being suspended in an infiltrant matrix comprising a braze material to form said multilayer wherein the multilayer of abrasive particles is provided on said structured abrading surface by coating the structured abrading surface with an abrasive particle and infiltrant matrix, said abrasive particles being suspended in a multilayer in its green state with a temporary binder and thereafter heating this coating to drive of the binder and cause infiltration of said infiltrant matrix thereby suspending the abrasive grit particles in the infiltrant matrix in a multilayer, said infiltrant matrix also being attached to the structured abrading surface by said infiltration.

2. The abrading tool of claim 1 wherein said irregular surface is a convex surface.

3. The abrading tool of claim 1 wherein irregular surface is a concave surface.

* * * * *